US009238881B2

(12) United States Patent
Griesshammer et al.

(10) Patent No.: US 9,238,881 B2
(45) Date of Patent: Jan. 19, 2016

(54) ROVING MACHINE FOR PRODUCING A ROVING AND METHOD FOR PIECING A FIBER SLIVER

(75) Inventors: Christian Griesshammer, Winterthur (CH); Petr Haska, Ceska Trebova (CZ)

(73) Assignee: Maschinenfabrik Rieter AG, Winterthur (CH)

( * ) Notice: Subject to any disclaimer, the term of this patent is extended or adjusted under 35 U.S.C. 154(b) by 78 days.

(21) Appl. No.: 14/130,413

(22) PCT Filed: Jun. 29, 2012

(86) PCT No.: PCT/CH2012/000145

§ 371 (c)(1),
(2), (4) Date: Apr. 7, 2014

(87) PCT Pub. No.: WO2013/003962

PCT Pub. Date: Jan. 10, 2013

(65) Prior Publication Data

US 2014/0208711 A1 Jul. 31, 2014

(30) Foreign Application Priority Data

Jul. 1, 2011 (CH) ..... 1108/11

(51) Int. Cl.

| | |
|---|---|
| ***D01H 1/11*** | (2006.01) |
| ***D01H 1/115*** | (2006.01) |
| ***D01H 15/00*** | (2006.01) |
| ***D01H 4/48*** | (2006.01) |
| ***D01H 7/92*** | (2006.01) |

(52) U.S. Cl.

CPC ..... *D01H 1/115* (2013.01); *D01H 4/48* (2013.01); *D01H 7/92* (2013.01); *D01H 15/00* (2013.01)

(58) Field of Classification Search

CPC ..... D01H 1/115; D01H 4/48; D01H 15/00
USPC ..... 57/263, 350, 403
See application file for complete search history.

(56) References Cited

U.S. PATENT DOCUMENTS 7,464,529 B2 * 12/2008 Stahlecker et al. ..... 57/263
7,647,760 B2 * 1/2010 Griesshammer et al. ..... 57/317

(Continued)

FOREIGN PATENT DOCUMENTS

DE 32 37 989 C2 10/1986
DE 10 2007 006674 A1 8/2008

(Continued)

OTHER PUBLICATIONS

PCT Search Report, Oct. 15, 2012.

*Primary Examiner* — Shaun R Hurley
(74) *Attorney, Agent, or Firm* — Dority & Manning, P.A.

(57) ABSTRACT

A roving machine and method for producing a roving from a fiber sliver has at least one spinning station with a vortex chamber, an infeed opening for the fiber sliver, and a roving forming element in the form of a spindle that has an inlet port and extends at least partially into the vortex chamber. The vortex chamber is associated with spinning nozzles through which air can be guided into the vortex chamber to impart, after a piecing process, a protective twist to the fiber sliver in the region of the inlet port. The spindle has a draw-off channel via which the roving provided with the protective twist is drawn out of the vortex chamber. Piecing nozzles are additionally associated with the vortex chamber, wherein each of the piecing nozzles has a flow direction which is aligned in the direction of the inlet port of the spindle.

12 Claims, 5 Drawing Sheets

(56) References Cited

U.S. PATENT DOCUMENTS

| | | | | |
|---|---|---|---|---|
| 7,661,259 | B2 * | 2/2010 | Griesshammer et al. | 57/209 |
| 2008/0276594 | A1 * | 11/2008 | Stahlecker et al. | 57/403 |

FOREIGN PATENT DOCUMENTS

| | | |
|---|---|---|
| EP | 0 375 242 | 6/1990 |
| JP | H03 53569 U | 5/1991 |

* cited by examiner

ROVING MACHINE FOR PRODUCING A ROVING AND METHOD FOR PIECING A FIBER SLIVER

FIELD OF THE INVENTION

The present invention relates to a roving machine for producing a roving from a fiber sliver. The roving machine has at least one spinning station which has a vortex chamber with an infeed opening for the fiber sliver and a roving forming element in the form of a spindle that has an inlet port and extends at least partially into the vortex chamber. The vortex chamber is associated with spinning nozzles through which air can be guided into the vortex chamber in order to impart, after a piecing process, a protective twist to the fiber sliver in the region of the inlet port. The spindle has a draw-off channel via which the roving provided with the protective twist can be drawn out of the vortex chamber. Furthermore, a method for piecing a fiber sliver on a roving machine used for producing a roving is described.

BACKGROUND

Roving is produced by means of roving machines from (e.g. doubled) fiber slivers that are pretreated in most cases by drafting, and it serves as feed for the subsequent spinning process in which the individual fibers of the roving are spun into a fiber yarn, for example by means of a ring spinning machine. In order to give the roving a certain strength, it has proved to be useful to draft the sliver during the production of the roving by means of a drafting arrangement, which in most cases is part of the roving machine, and subsequently to provide it with a protective twist. The mentioned strength is important in order to prevent the roving from breaking during winding onto a bobbin or during feeding to the downstream spinning machine. However, the applied protective twist must only be strong enough that a cohesion of the individual fibers during the individual winding and unwinding processes and the adequate transport processes between the respective machine types is ensured. On the other hand, it has also to be ensured, despite the protective twist, that the roving can be further processed in a spinning machine—thus, the roving has still to be draftable.

In order to produce a corresponding roving, so-called flyers are primarily used; however, the delivery speed of the flyers is limited due to the occurring centrifugal forces. Thus, many different proposals have already been made to avoid the flyer or to replace it by an alternative machine type (see, for example, EP 0 375 242 A1, DE 32 37 989 C2).

In this connection it has already been proposed, among other things, to produce roving by means of air-jet spinning machines in which the protective twist is generated by means of air flows. The basic principle here is to guide a fiber sliver through a vortex chamber in which an air vortex is generated. The air vortex finally affects that a portion of the outer fibers are wound as so-called wrap fibers around the centrally extending fiber strand which, in turn, consists of core fibers which extend substantially parallel to each other.

However, as with the spinning of yarn, producing a roving usually also requires to piece the fiber sliver fed to the roving machine before the actual spinning process can be started. A corresponding piecing can be required, for example, upon switching on the spinning machine or after a breakage of the roving or the fiber sliver.

In spinning machines, it is prior art that the yarn end unwound from the bobbin is fed counter to the actual spinning direction through the spinning station and is connected to the fiber sliver delivered from the drafting arrangement. After passing the connecting station, the desired yarn is finally produced in the spinning station.

However, due to the above-mentioned properties of the produced roving, in particular the desired draftability thereof, a defined feeding of the roving back into or through the spinning station is only possible with great difficulties.

SUMMARY OF THE INVENTION

It is therefore an object of the present invention to provide an air-jet roving machine and a method which enable a fast and reliable piecing of a fiber sliver. Additional objects and advantages of the invention will be set forth in part in the following description, or may be obvious from the description, or may be learned through practice of the invention.

The objects are achieved by a roving machine and a method with the features described herein and set forth in the claims.

According to the invention, the roving machine is characterized in that in addition to the spinning nozzles, piecing nozzles are associated with the vortex chamber in which the actual roving production takes place. Moreover, each of the piecing nozzles has a flow direction that is aligned in the direction of the inlet port of the spindle. The piecing nozzles are therefore aligned such that during the piecing process, an air flow can be generated therewith that extends through the inlet port into the draw-off channel. This air flow affects suction in the region of the infeed opening of the vortex chamber. If now, for example by means of a drafting arrangement upstream of the spinning station, the fiber sliver to be pieced is delivered into the vortex chamber or in the region of the infeed opening thereof, said fiber sliver is suctioned by the suction in the direction of the inlet port and finally—supported by the air flow extending into the draw-off channel—also arrives in the draw-off channel. As a result, feeding the fiber sliver into the spindle takes place in the spinning direction, whereas in yarn productions known from the prior art, it is common to feed the yarn counter to the spinning direction into the spinning station. In order to enable drawing off the fiber sliver fed during the piecing process through the draw-off channel, it is additionally required to provide the fiber sliver with a certain strength. It is therefore of advantage if the air flow generated by the piecing nozzles affects a movement of the fiber sliver not only into or through the draw-off channel. Rather, the piecing nozzles should be aligned such that, in addition, a protective twist can also be imparted to the fiber sliver. This increases the strength of the fiber sliver significantly so that after passing the spindle, the fiber sliver can be gripped by suitable handling devices and can be fed to the subsequent process. As soon as the fiber sliver provided with the protective twist has left the spindle, it is finally possible to start the "normal" spinning process in which the air supply to the piecing nozzles is interrupted and the spinning nozzles are pressurized with air. Thus, as a result, a spinning machine is proposed by means of which the end section of a correspondingly fed fiber sliver can be pieced in the later spinning device. Complicated guiding of the already-produced roving counter to the spinning direction and therefore also through the draw-off channel is not necessary.

It is particularly advantageous if the piecing nozzles are aligned such that individual air flows generated by the piecing nozzles, in plan view on the inlet port, enter the draw-off channel tangentially. Hereby, the air flows also impinge with a tangential movement component on the fiber sliver entering the inlet port of the spindle, thereby affecting the desired protective twist. However, since the air flow also shall affect the described suction and the linear movement of the fiber sliver into or through the draw-off channel, the air flow must also have a direction component here that extends into the inlet port. As a result, the piecing nozzles should generate an air flow that comes from the direction of the infeed opening of the vortex chamber and impinges with a tangential component on the inner wall of the draw-off channel, and finally propagates with a rotational movement towards the outlet of the draw-off channel.

Furthermore, it is advantageous if the piecing nozzles, viewed in the axial direction of the draw-off channel, are arranged between the infeed opening of the vortex chamber and the inlet port of the spindle. This allows an alignment of the piecing nozzles according to the invention without requiring significant modifications of the remaining spinning station for this. Preferably, the spinning nozzles are also arranged in the mentioned region, wherein they are normally aligned such that the generated air flow impinges mainly on the outer surface of the spindle so as to generate the desired protective twist. Furthermore, the piecing nozzles (again viewed in the axial direction of the draw-off channel) can be arranged between the spinning nozzles and the inlet port of the spindle. However, it is also conceivable that the spinning nozzles are located between the infeed opening of the vortex chamber and the spinning nozzles.

Likewise, it is advantageous if the piecing nozzles are aligned such that the protective twist can be imparted within the draw-off channel. The twisting of the air flow is particularly stable and uniform here since the draw-off channel serves as a guide of the fiber sliver when imparting the protective twist.

Alternatively or additionally, it can also be of advantage if the piecing nozzles are aligned such that the protective twist can already be imparted in the region of the inlet port. Imparting the protective twist takes place here at the earliest possible stage so that a particularly high tensile strength can be achieved. The risk that the fiber sliver breaks when drawn out of the draw-off channel is hereby reduced. Whether the protective twist is imparted primarily in the region of the inlet port or inside the draw-off channel can finally be influenced through alignment and placement of the piecing nozzles.

Furthermore, it is advantageous if the piecing nozzles are at least partially arranged in a wall section surrounding the vortex chamber. In this case, the piecing nozzles can be securely fastened and can be precisely aligned with the inlet port of the spindle. Here, the piecing nozzles can be drilled into the wall or can also be connected in a different manner, in particular detachably connected in the form of inserts. Apart from this, the number of piecing nozzles can be freely selected, wherein it has proved to be advantageous to distribute the piecing nozzles uniformly around the inlet port.

Likewise, it is advantageous if upstream of the vortex chamber there is a fiber guiding element with a fiber guiding channel that leads into the infeed opening of the vortex chamber, and that the piecing nozzles are at least partially arranged in the fiber guiding element. This allows a simple replacement of the piecing nozzles by replacing the fiber guiding element. Moreover, the fiber guiding elements, which normally guide the fiber sliver between a drafting arrangement and the infeed opening of the vortex chamber, are in most cases adapted to the fiber material to be spun. If the piecing nozzles are arranged within this fiber guiding element, they can also be adapted to the respective fiber material in terms of arrangement, number and alignment. By changing the fiber guiding element, the roving machine is therefore suited not only for spinning the respective fiber material into a roving. Rather, through the correct selection of the fiber guiding element, it is ensured in this case at the same time that the piecing nozzles are also designed for the fiber material to be spun so that piecing the fiber material can be carried out without any problem in the direction of the later spinning direction.

Furthermore, it can be of advantage if the piecing nozzles can be pressurized with air independent of the spinning nozzles so as to implement an individually adjustable air flow. As a result, it is finally possible to operate only the piecing nozzles during the piecing process and to operate only the spinning nozzles during the subsequent spinning process, i.e., to pressurize them with air. Alternatively, it is finally also conceivable that during the piecing process, a certain air flow can also be generated by the spinning nozzles. Likewise, there is the possibility to support the spinning process by an additional air flow generated by the piecing nozzles.

Also, there are advantages if the roving machine has a control and/or feedback control unit that is configured to pressurize during the piecing process only the piecing nozzles with air, and to pressurize during a spinning process following the piecing process only the spinning nozzles with air. Thus, both arrangements can be designed specifically for their respective task without the need that mutual interaction of the individual air flows is to be taken into account. Switching on and off the respective nozzles can be carried out, for example, by means of corresponding valves. However, it also conceivable to connect the nozzles via a flow deflector to only one air supply so that depending on the position of the deflector, either the piecing nozzle or alternatively the spinning nozzle can be pressurized with air. Moreover, the respective pressurization with air can be carried out manually but also automatically, for example based on measured quality features of the produced roving.

There are particular advantages if the inlet port of the spindle has an inner diameter, the value of which ranges between 4 mm and 12 mm, preferably between 6 mm and 8 mm. When adhering to the mentioned diameter limits, a particularly advantageous air flow develops during the roving spinning process in the region of the inlet port of the spindle and affects that only a portion of the outer fiber ends are picked up and are wound with the desired strength around the actual fiber core. In contrast, if the diameter is below 4 mm, this gradually approaches the range that is known from conventional air-jet spinning and that results in a relatively strong yarn which, due to the missing draftability, is not suited as roving.

The method according to the invention is finally characterized in that for piecing a fiber sliver, a roving machine according to the above description is used, wherein during the piecing process, the fiber sliver is moved by means of the air flow generated by the piecing nozzles in a linear movement into the draw-off channel, and wherein by means of the air flow, a protective twist is imparted to the fiber sliver in addition to the linear movement. The method according to the invention thus allows a "forward piecing", i.e., a piecing process in which the fiber sliver is fed during piecing in the direction of the later spinning direction (from the infeed opening of the vortex chamber through the vortex chamber into the draw-off channel of the spindle) into the vortex chamber and is guided by the air flow into the inlet port of the spindle. Since the air flow extends through the inlet port into the draw-off channel and therefore leaves the vortex chamber on the same path as the fiber sliver, the air flow, besides imparting the protective twist, also affects a transport of the fiber sliver through the draw-off channel. As a result, fast and in addition also reliable piecing is possible without the need that the spinning chamber has to be opened for this or an already-produced roving has to be guided counter to the actual spinning direction into or through the vortex chamber.

It is of advantage here if, during the piecing process, only the piecing nozzles are pressurized with air so as to feed a fiber sliver end section provided for piecing through the inlet port into the draw-off channel of the spindle and to provide it with a protective twist, that after passing the draw-off channel, the end section having the protective twist can be taken over by a handling device, and that for producing the roving after completion of the piecing process, only the spinning nozzles are pressurized with air. In this manner, the respective nozzles can be optimally aligned for their respective task (piecing a fiber sliver versus producing a roving). On the other hand, mutual interference between the respective air flows does not occur.

Also, it is extremely advantageous if after passing the draw-off channel, the end section having the twist is wound onto a bobbin by means of a winding device. Finally, in this stage it is reasonable to switch off the piecing nozzle arrangement and to switch on the spinning nozzle arrangement so as to transition again into the roving spinning process.

BRIEF DESCRIPTION OF THE DRAWINGS

Further advantages of the invention are described in the following exemplary embodiments. In the figures.

DETAILED DESCRIPTION

Figure 1:
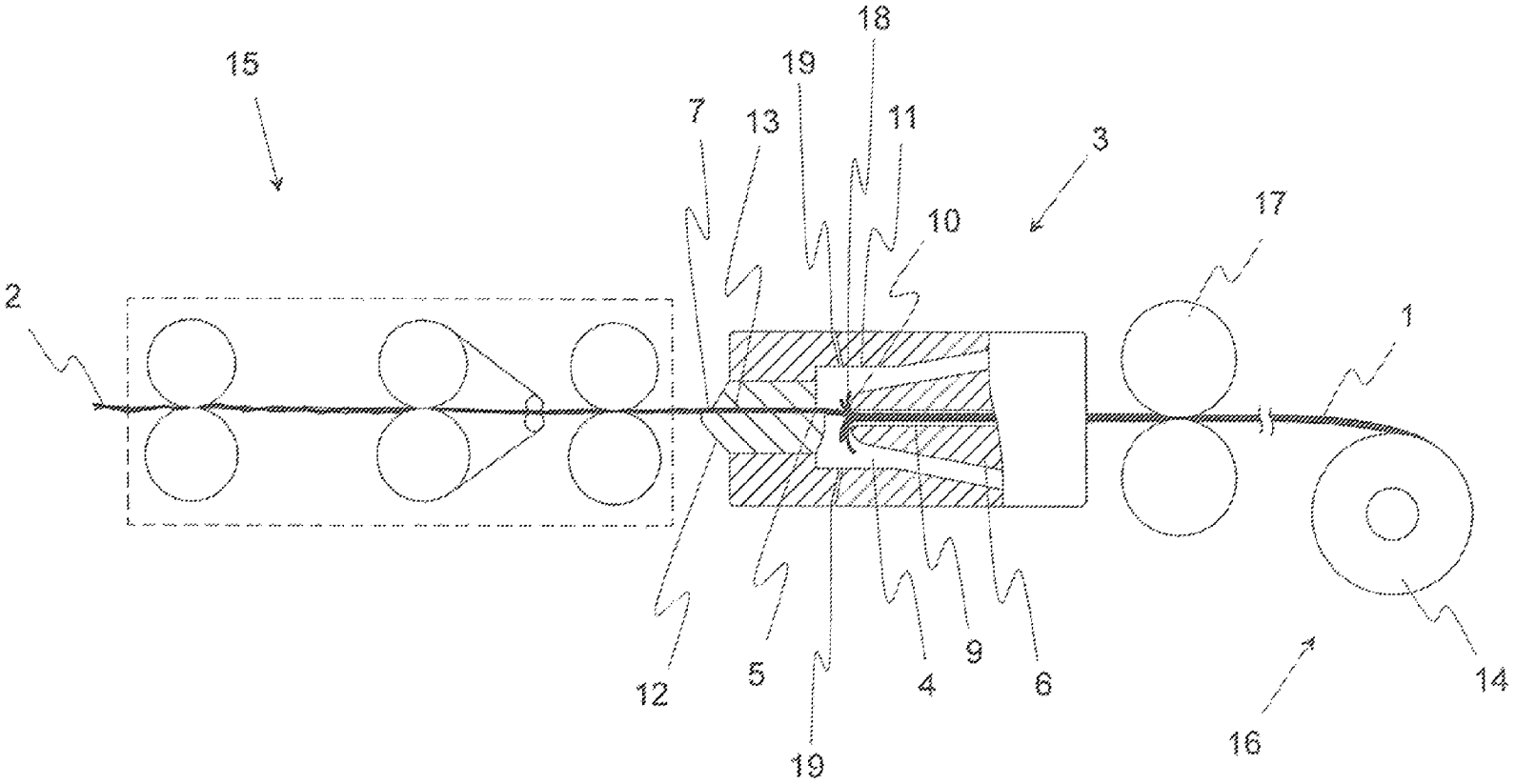
FIG. 1 shows a schematic view of a roving machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic view of a detail of a roving machine. If necessary, the roving machine can comprise a drafting arrangement 15 to which a fiber sliver 2, for example in the form of a doubled drafter sliver, is delivered. The roving machine shown further comprises principally a spinning station 3 that is spaced apart from the drafting arrangement 15 and has an internal vortex chamber 4 in which the fiber sliver 2 or at least a portion of the fibers of the fiber sliver 2 is provided with a protective twist (the exact principle of operation of the spinning station 3 is described in greater detail hereinafter).

Furthermore, the roving machine can comprise a pair of draw-off rollers 17 and a winding device 16 (schematically illustrated) that is arranged downstream of the pair of draw-off rollers 17 and has a bobbin 14 for winding the roving 1 that leaves the spinning station 3 and has the desired protective twist. The device according to the invention does not necessarily have to have a drafting arrangement 15 as it is illustrated in FIG. 1. Also, the pair of draw-off rollers 17 is not mandatory.

The spinning device operates according to an air-jet spinning method. For forming the roving 1, the fiber sliver 2 is now guided through a fiber guiding channel 13 of a fiber guiding element 12, which fiber guiding channel has an adequate inlet opening 7, and is guided from there via an infeed opening 5 into the vortex chamber 4 of the spinning station 3 (see also FIG. 2). There, the fiber sliver is provided with a protective twist, i.e., at least a portion of the fibers of the fiber sliver 2 is entrained in an air flow that is generated by spinning nozzles 19 that are adequately arranged in a wall section 11 that borders the vortex chamber 4. Here, a portion of the fibers is drawn out of the fiber sliver 2 at least to a certain extent and is wound around the tip of a spindle 6 that protrudes into the vortex chamber 4. Due to the fact that the fiber sliver 2 is drawn out of the vortex chamber 4 through an inlet port 10 of the spindle 6 and via a draw-off channel 9 arranged within the spindle 6, the free fiber ends 18 (see FIG. 1) are finally also drawn in the direction of the inlet port 10 and thereby wind themselves as wrap fibers around the centrally extending core fibers—resulting in a roving 1 having the desired protective twist.

With regard to the spinning nozzles 19 it should be mentioned here purely as a precaution that these nozzles should usually be aligned such that the outflowing air-jets are equidirectional so as to jointly generate an equidirectional air flow having a rotational direction. Preferably, the individual spinning nozzles 19 are arranged rotationally symmetrically with respect to each other.

Preferably, the spinning station 3 according to the invention also has a twist congesting element that is inserted, for example, in the fiber guiding element 12. The latter can be formed as a fiber delivery edge, as a pin or as any other embodiment known from the prior art, and it prevents that a twist in the fiber sliver 2 propagates counter to the delivery direction of the fiber sliver 2 and thus in the direction of the entry opening 14 of the fiber guiding element 12.

After starting-up the spinning system, after a break of the produced roving 1 or after a controlled shutting down of the spinning system, the fiber sliver 2, which in most cases is delivered from a drafting arrangement 15, has to be pieced. In the prior art relating to yarn production by means of air-jet spinning machines, it is common practice to feed the end section of an already-spun yarn counter to the actual spinning direction through the draw-off channel 9 into the vortex chamber 4. It is also conceivable to transport the yarn back far enough that the yarn end is positioned in the region between the drafting arrangement 15 and the fiber guiding element 12 or between the individual rollers of the drafting arrangement 15. There, it is finally connected to the fiber sliver 2 and together with the latter it is fed again into the vortex chamber 4.

However, in the case of the roving 1, such a backward movement is fairly difficult since the roving has a certain draftability and thus a low compressive strength in the direction of its longitudinal axis.

Figure 3:
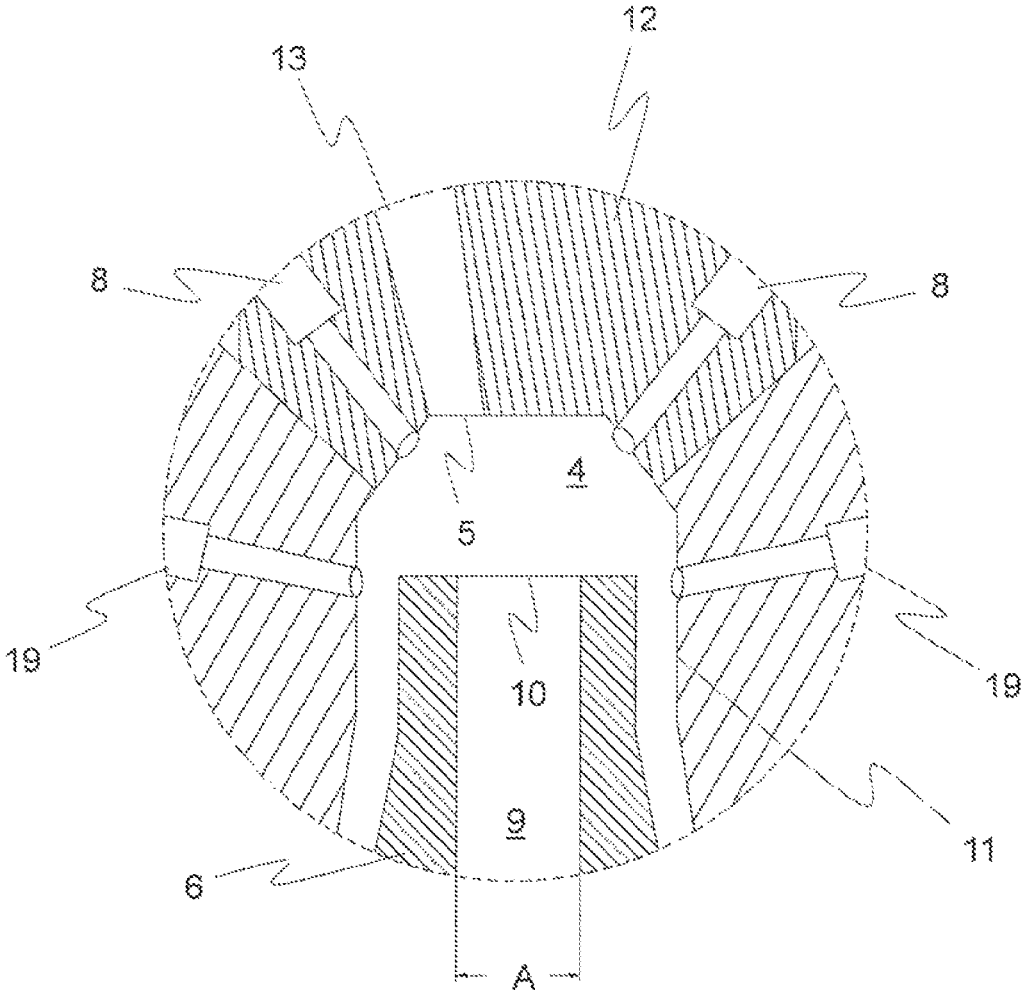
FIG. 3 shows an enlarged illustration of the region "W" in FIG. 2, bordered by a circle illustrated with a dashed line, but in addition with piecing nozzles according to the invention.
Figure 4:
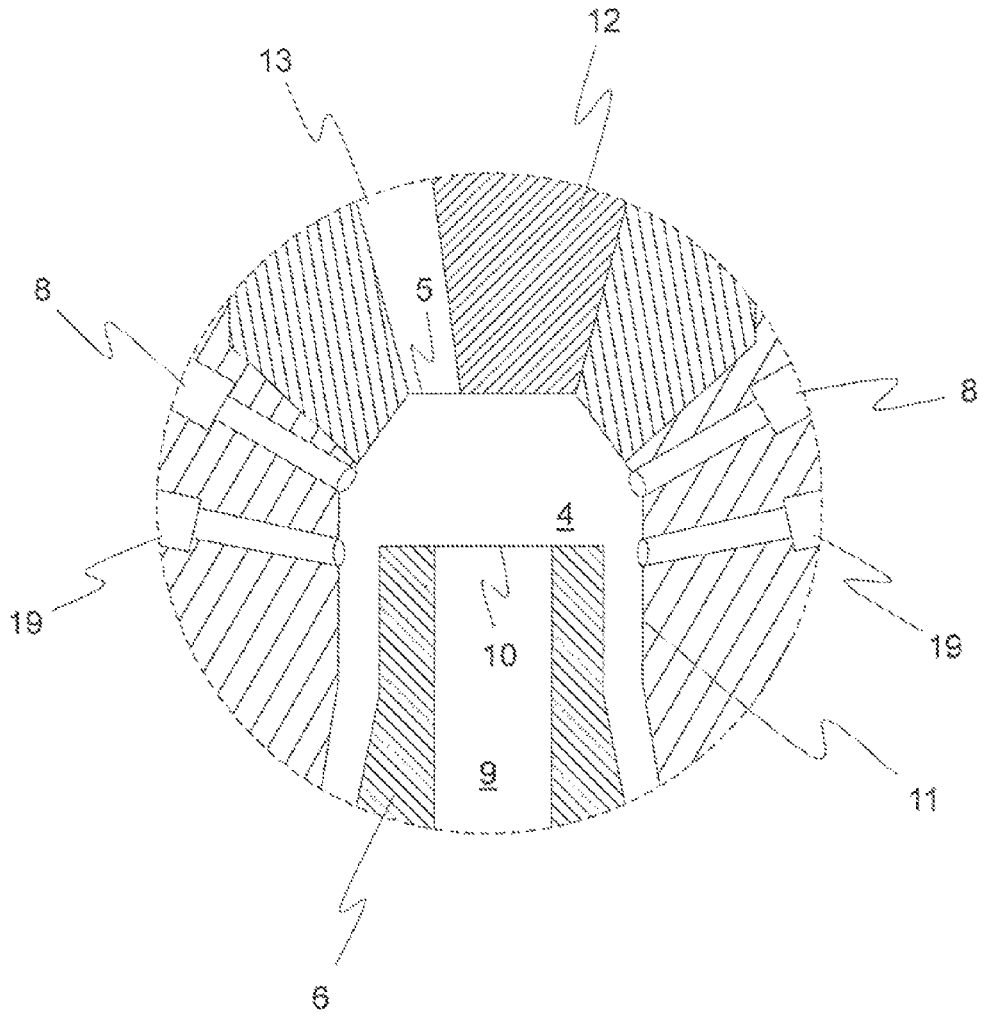
FIG. 4 shows an illustration according to FIG. 3, but with the positioning of the piecing nozzles according to the invention deviating therefrom.
Figure 5:
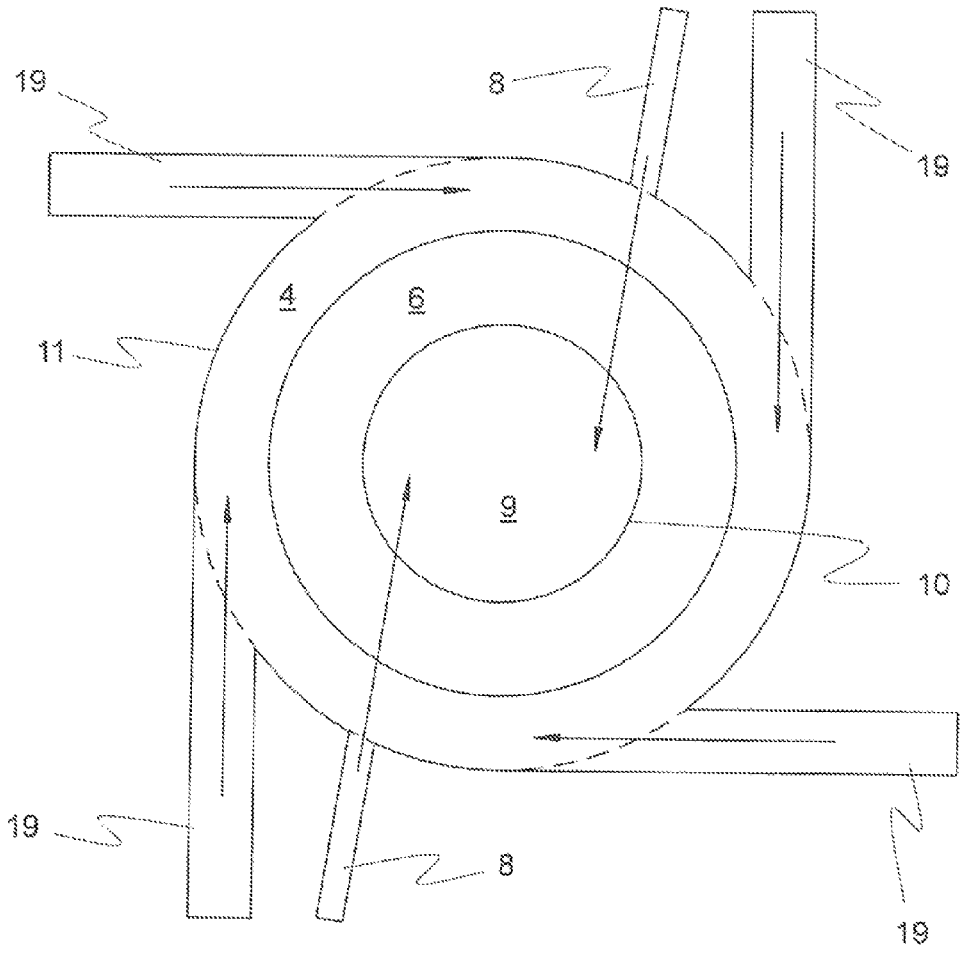
FIG. 5 shows a sectional view of a spinning station according to the invention as a top view on the inlet port of the spindle.

The basic point of the present invention is apparent from the FIGS. 3 to 5. While the FIGS. 3 and 4 show two alternative embodiments of a spinning station 3 according to the invention, which differ from each other merely with regard to the positioning of the piecing nozzles 8 described below, FIG. 5 shows a schematic sectional view of a spinning station 3 according to the invention as a top view on the inlet port 10 of the centrally arranged spindle 6.

Figure 2:
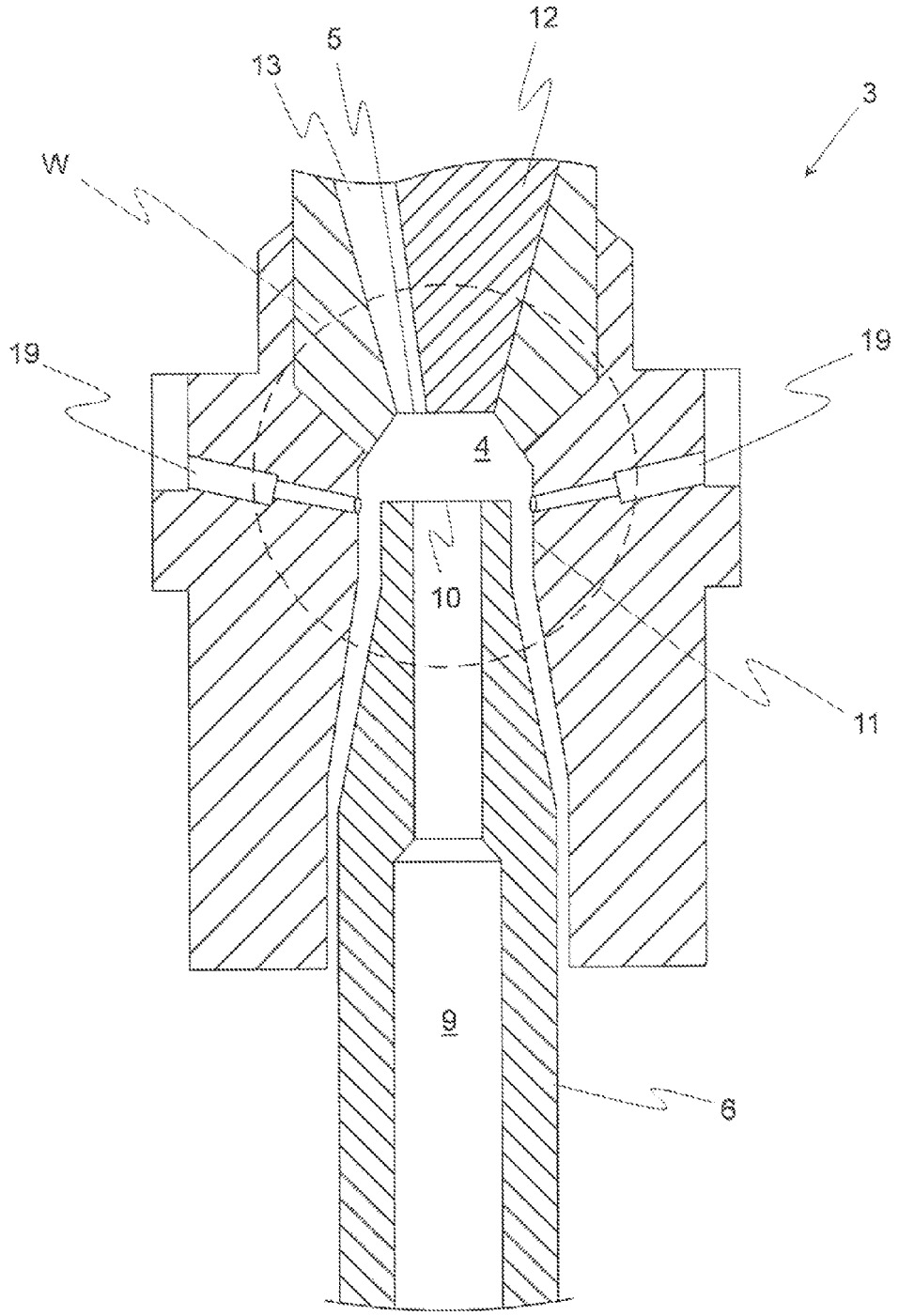
FIG. 2 shows a sectional view of a spinning station of a roving machine.

As can be seen from the overall view of the individual Figures, the roving machine according to the invention has two piecing nozzles 8 according to the invention in addition to the spinning nozzles 19 described in connection with the FIGS. 1 and 2.

The purpose and the mode of operation of these piecing nozzles 8 (which, apart from that, can also be formed as flow gap or as any other elements generating a corresponding air flow) is the following:

As soon as a corresponding piecing process is due, the piecing nozzles 8 are pressurized with compressed air, wherein the spinning nozzles 19 responsible for the spinning process are shut down or will be shut down (i.e., the air supply is disconnected). Since the piecing nozzles 8 or their longitudinal axes are now aligned in the direction of the inlet port 10 of the spindle 6, an air flow is generated that extends via the inlet port 10 into the draw-off channel 9 of the spindle 6. Thus, suction develops in the region of the inlet opening 7 (FIG. 1) of the fiber guiding element 12. If now a fiber sliver 2 is fed, for example from an upstream drafting arrangement 15, into the fiber guiding channel 13, the fiber sliver is sucked by the mentioned suction into the vortex chamber 4. Depending on the pressure conditions, it can even be already sufficient here to transport the fiber sliver 2 by means of the drafting arrangement 15 only up to the region of the inlet opening 7 of the fiber guiding element 12 since the negative pressure "propagates" up to this region. In any case, the alignment of the piecing nozzles 8 effects that the fiber sliver 2 is suctioned in the direction of the inlet port 10 of the spindle 6.

As soon as the end section of the fiber sliver 2 inserted or suctioned into the vortex chamber 4 has passed the inlet port 10 of the spindle 6, the air flow extending into the draw-off channel 9 causes the fiber sliver 2 to move further through the draw-off channel 9 up to a draw-off opening, which is not shown here.

After outfeeding the fiber sliver 2 transported in this manner, it is now desirable to grip the fiber sliver by means of a handling device, for example a gripper element of a service robot, and to transfer it to a further machine component, e.g., to the bobbin 14 of a winding device 16.

In order to give the fiber sliver 2 the strength necessary for this, the invention provides in addition that the piecing nozzles 8 are aligned such that the fiber sliver 2 is subjected not only to a linear movement, but at the same time also to a certain protective twist. Thus, the piecing nozzles 8 are preferably arranged such that the generated air flow, in a plan view on the spindle 6 (see FIG. 5), enters the inlet port 10 approximately tangentially. When the air flow impinges on the surface of the fiber sliver 2 while the fiber sliver passes through, a protective twist is imparted to the fiber sliver 2. Here, the protective twist can already be imparted in the region of the inlet port 10 or during the transport through the draw-off channel, wherein the degree of twisting, the twist angle and the exact place of imparting the protective twist can be influenced by corresponding alignment of the piecing nozzles 8.

As a result, by imparting the protective twist, the fiber sliver 2 is provided with a tensile strength that allows to grip the fiber sliver 2 after passing the draw-off channel 9, and to feed it, e.g., to the winding device 16. After completion of the piecing process, the air supply to the piecing nozzles 8 is disconnected again. In return, the spinning nozzles 19 are pressurized with air so as to produce the desired roving 1. The respective air flows are illustrated in FIG. 5 by corresponding arrows, wherein it should be noted again that it is advantageous that during piecing only the piecing nozzles 8, and during the spinning process (i.e., the production of the roving 1) only the spinning nozzles 19 are pressurized with air (thus, FIG. 5 does not mean that the spinning nozzles 19 and the piecing nozzles 8 have to simultaneously generate corresponding air flows).

Finally, it has proved to be advantageous that the inner diameter A of the inlet port 10 (see FIG. 3) has a value between 4 mm and 12 mm, preferably between 6 mm and 8 mm.

Apart from this, the invention is not limited to the illustrated exemplary embodiments. Rather, all combinations of the described individual features as they are shown or described in the claims, the description and the Figures, and in so far as a corresponding combination appears to be technically possible or reasonable, are subject matter of the invention. Thus, for example, there can be further piecing nozzles 8 in addition the piecing nozzles 8 shown.

The invention claimed is:

1. A roving machine for producing a roving from a fiber sliver, comprising:

a spinning station having a vortex chamber with an infeed opening for the fiber sliver, the vortex chamber further comprising a spindle that extends at least partially into the vortex chamber, the spindle comprising an inlet port;

a plurality of spinning nozzles configured with the vortex chamber through which pressurized air is guided into the vortex chamber to impart a protective twist to the fiber sliver at the inlet port;

the spindle further comprising a draw-off channel through which the fiber sliver is drawn out of the vortex chamber;

a plurality of piecing nozzles configured with the vortex chamber separate from the spinning nozzles, the piecing nozzles aligned so as to direct pressurized air in a flow direction into the inlet port of the spindle; and wherein the piecing nozzles are disposed between the infeed opening of the vortex chamber and the inlet port of the spindle.

2. The roving machine as in claim 1, wherein the piecing nozzles are further aligned so as to impart a tangential component to the flow direction relative to an axis of the draw-off channel.

3. The roving machine as in claim 1, wherein the piecing nozzles impart a protective twist to a fiber sliver within the draw-off channel during a piecing process.

4. The roving machine as in claim 3, wherein the piecing nozzles are arranged such that the protective twist is imparted to the fiber sliver at the inlet port.

5. The roving machine as in claim 1, wherein the piecing nozzles are arranged in a wall section surrounding the vortex chamber.

6. The roving machine as in claim 1, further comprising a fiber guiding element arranged upstream of the vortex chamber, the fiber guiding element comprising a fiber guiding channel into the vortex chamber, the piecing nozzles configured in the fiber guiding element.

7. The roving machine as in claim 1, wherein the piecing nozzles are pressurize with air independently from the spinning nozzles.

8. The roving machine as in claim 7, further comprising a control unit configured to pressurize only the piecing nozzles during a piecing process, and to pressurize only the spinning nozzles during a spinning process following the piecing process.

9. The roving machine as in claim 1, wherein the inlet port of the spindle has an inner diameter between 4 mm and 12 mm.

10. A method for piecing a fiber sliver and a roving in a roving machine having spinning nozzles used during a spinning process, a spinning station having a vortex chamber with an infeed opening for the fiber sliver, the vortex chamber further comprising a spindle that extends at least partially into the vortex chamber, the spindle comprising an inlet port and draw-off channel, the method comprising:

for piecing, generating an air flow in the vortex chamber of the roving machine with piecing nozzles that are separate from the spinning nozzles, the air flow directed linearly into the inlet port; and with the air flow, drawing the fiber sliver linearly into the inlet port of the spindle and generating a protective twist to the fiber sliver.

11. The method as in claim 10, further comprising pressurizing only the piecing nozzles with air during piecing so as to feed an end section of the fiber sliver through the inlet port of the spindle and impart an protective twist to the fiber sliver, and pressuring only the spinning nozzles for producing the roving after completion of piecing.

12. The method as in claim 11, wherein during piecing, the end section of the fiber sliver passes through the draw-off channel and is wound onto a bobbin.

* * * * *